US005365592A

United States Patent [19]

Horner et al.

[11] Patent Number: 5,365,592

[45] Date of Patent: Nov. 15, 1994

[54] DIGITAL VOICE DETECTION APPARATUS AND METHOD USING TRANSFORM DOMAIN PROCESSING

[75] Inventors: Robert W. Horner, Whittier; Kheim V. Cai, Brea; Ronald L. Bergen, Irvine; Keith A. Lane, Huntington Beach, all of Calif.

[73] Assignee: Hughes Aircraft Company, Los Angeles, Calif.

[21] Appl. No.: 555,114

[22] Filed: Jul. 19, 1990

[51] Int. Cl.[5] ..... G10L 5/00

[52] U.S. Cl. ..... 381/46; 381/49

[58] Field of Search ..... 381/42, 43, 45, 46, 381/47, 49, 50; 364/513.5; 367/135, 198, 199, 43

[56] References Cited

U.S. PATENT DOCUMENTS

| | | | |
|---|---|---|---|
| 3,566,035 | 2/1971 | Noll et al. | 381/41 |
| 4,058,676 | 11/1977 | Wilkes et al. | 381/41 |
| 4,219,695 | 8/1980 | Wilkes et al. | 381/43 X |
| 4,829,574 | 5/1989 | Dewhurst et al. | 381/43 X |
| 4,884,247 | 11/1989 | Hadidi et al. | 367/43 |

OTHER PUBLICATIONS

"Cepstrum Pitch Determination", The Journal of the Acoustical Society of America vol. 41; 1967 pp. 293–309; A. Noll.

"Digital Signal Processing," Oppenheim & Schafer, Prentice-Hall, 1975, pp. 512–519.

*Primary Examiner*—Tod R. Swann

*Attorney, Agent, or Firm*—W. K. Denson-Low

[57] ABSTRACT

A waveform characterizer apparatus is disclosed for extracting cepstrum pitch and spectral properties of a waveform signal such as the baseband audio output of a receiver. The apparatus employs Fourier processing, cepstral processing, magnitude detection, logarithms processing, frequency selective filtering and time/frequency windowing to extract cepstrum pitch and spectral rolloff characteristics which can then be used to determine the signal type. One application of the invention is in a digital voice/squelch apparatus.

27 Claims, 8 Drawing Sheets

DIGITAL VOICE DETECTION APPARATUS AND METHOD USING TRANSFORM DOMAIN PROCESSING

BACKGROUND OF THE INVENTION

The present invention relates to voice communication systems, and more particularly to a technique for detecting characteristics of a received signal in the frequency or transform domain to detect received voice signals.

Present voice detection (squelch) techniques use one of the following approaches:

1. "Zero crossing" of the received signal in the time domain are counted to determine the mean frequency, and compare the mean frequency against 1 KHz to determine the existence of voice. This technique does not take advantage of the entire audio spectrum and has a high false alarm rate.
2. The cross-correlation of voice signal with tone is calculated to determine pitch period. This technique is corrupted heavily by noise and is also time-consuming.
3. An out-of-band CW tone used to allow the receiver to detect transmission. A disadvantage of this technique is that energy is spent on the CW tone, thus reducing the amount of power available for voice transmission. In addition, this technique requires the transmitter to send the CW tone and therefore it cannot be implemented in existing radios without circuit modification.

SUMMARY OF THE INVENTION

In accordance with the invention, a waveform characterizer apparatus is disclosed for determining cepstrum pitch and spectral rolloff properties of an input signal waveform. The apparatus comprises means for digitizing the audio signal waveform to provide a digital waveform signal, and means for providing the cepstrum of the audio signal waveform. The apparatus further includes cepstral processing means for isolating the pitch period of the audio signal waveform as a single peak in the cepstrum located at the period of the signal and determining the peak pitch magnitude value, and means for determining the spectral rolloff of the audio signal waveform from the cepstrum of the audio signal waveform.

In a preferred embodiment, the means for providing the cepstrum of the audio waveform comprises means for transforming the digitized audio signal waveform into the frequency domain, such as a FFT, and means for deconvolving the impulse response and periodicity of the frequency domain signal to provide a deconvolved digital signal. The deconvolving means may be implemented by means for squaring the magnitudes of the transformed spectral data, and and performing a logarithm function on the squared data means for transforming the deconvolved digital signal back into the time domain to provide the cepstrum of the audio signal waveform.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

The baseband audio bandwidth output of a receiver system contains information transmitted from some other location. If a detailed knowledge is available about the type of information being transmitted, the method of transmission used, and the time at which that signal is transmitted, then detection and timely processing of that information is straightforward. If, however, this information is not available, then the correct processing of the received signal is more difficult.

This invention comprises a technique that can be used to extract characteristics from a baseband signal and use these characteristics to determine the type of signal present in the receiver output. The technique can be used to detect the presence of a number of different types of modulated signals even when these signals are corrupted by noise. The invention uses Fourier processing, cepstral processing, magnitude detection, logarithmic processing, frequency selective filtering and time/-frequency windowing to separate the signal into characteristics which can then be used to determine the signal type.

Most transmissions can be modelled as an impulse train convolved with some impulse response characteristic. Voice, for example, is generally modelled as a vocal chord excitation (a periodic impulse train) convolved with the impulse response of the vocal tract. This periodic impulse train can be detected by the use of a deconvolution technique known as the cepstrum. The result of the cepstrum is the separation of the impulse train characteristic from the impulse response characteristic of the system. The impulse train transforms into a single peak located at the pitch period of the signal, while the response characteristic transforms into the time domain response of the system. See, e.g., *Digital Signal Processing*, Oppenheim & Schafer, Prentice-Hall, 1975, at paragraph 10.7.1, pages 512–519.

The present detection technique uses digital signal processing in the transform domain to detect and characterize RF or baseband signals such as voice, M-ary FSK or PSK. The characterization can then be used for verification of reception, tracking or demodulation.

Waveform Characterizer Procedure and Algorithm

Figure 1:
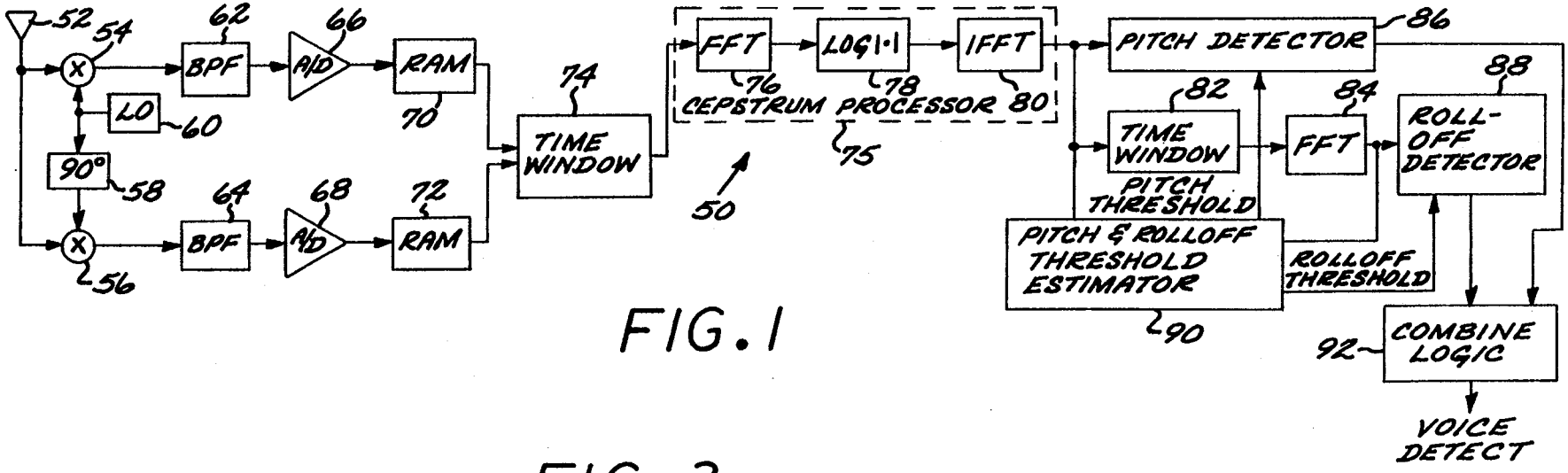
FIG. 1 illustrates a simplified block diagram of a waveform characterizer apparatus in accordance with the invention.

A simplified block diagram of a waveform characterizer apparatus is shown in FIG. 1. The characterizer apparatus 50 comprises:

(a) circuitry for generating in-phase and quadrature components of an incoming signal, e.g., a signal received at antenna 52; in this embodiment this circuitry includes downconverting mixers 54 and 56, 90° phase shift device 58 and bandpass filters 62 and 64.
(b) analog-to-digital converters 66 and 68 for digitizing the in-phase and quadrature signals;
(c) memory devices 70 and 72 to store the digitized signal during analysis; in a preferred embodiment, the memory devices are random access memories;
(d) a time window function 74 for performing, e.g., a Hamming window;
(e) a forward fast Fourier transformer (FFT) 76 to transform the time domain digital signals into the frequency domain;
(f) a log function 78 to deconvolve the impulse response and periodicity of the signal;
(g) an inverse FFT 80 to transform the frequency domain signal into the cepstral time domain;
(h) a time window function 82 to remove the pitch period from the cepstrum;
(i) a forward FFT 84 to transform the cepstrum back into the frequency domain;
(j) a pitch detector 86 for detecting the pitch of the signal;
(k) a rolloff detector 88 responsive to the frequency domain, smoothed spectrum for detecting the spectral rolloff;
(l) a pitch and rolloff threshold estimator 90; and
(m) combining logic 92 responsive to the pitch and rolloff to detect voice.

Figure 3:
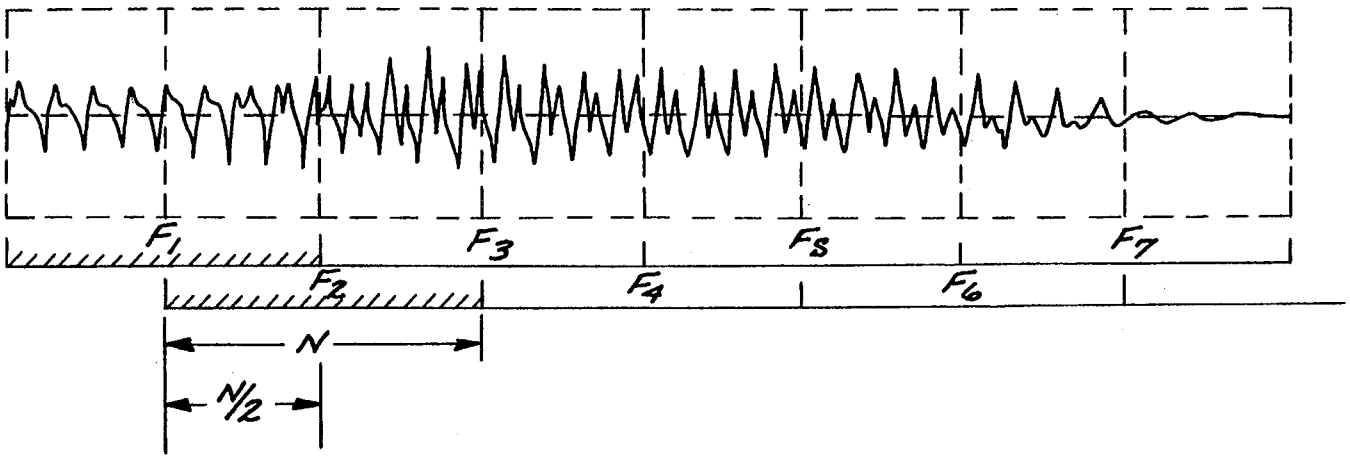
FIG. 3 illustrates the overlapping of frame processing utilized by the system of FIG. 1.
Figure 2A:
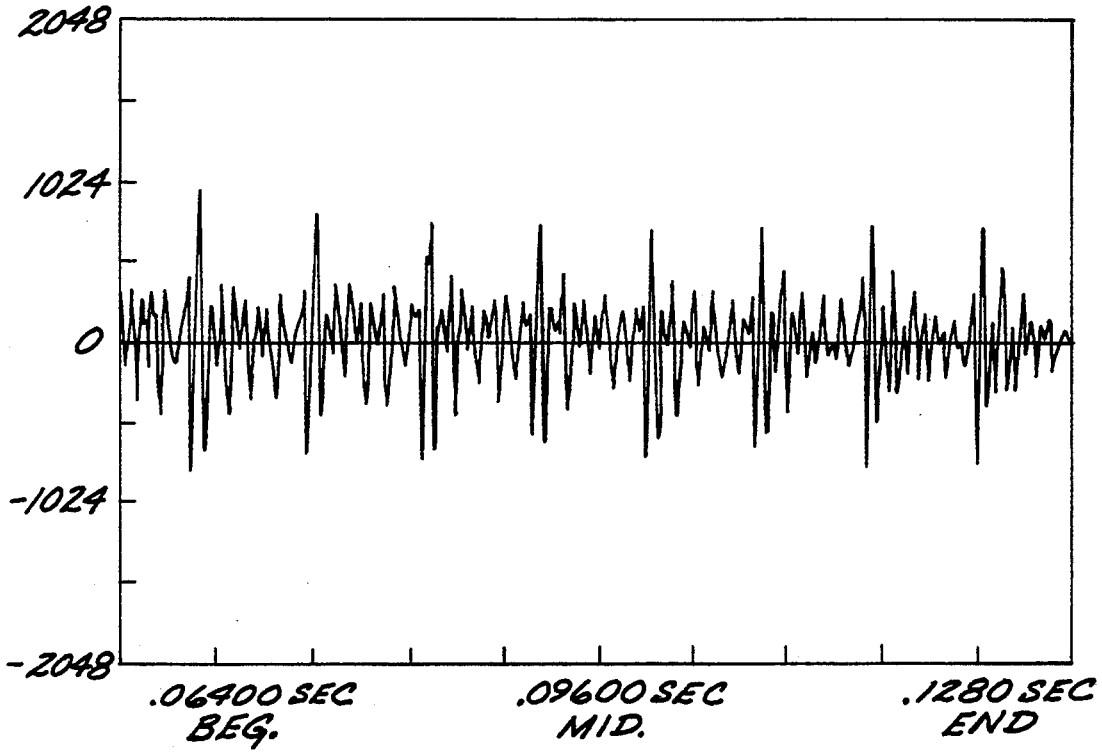
FIGS. 2A and 2B show an exemplary voice waveform signal in the time and frequency domain of an exemplary input signal to the voice characterizer of FIG. 1.
Figure 2B:
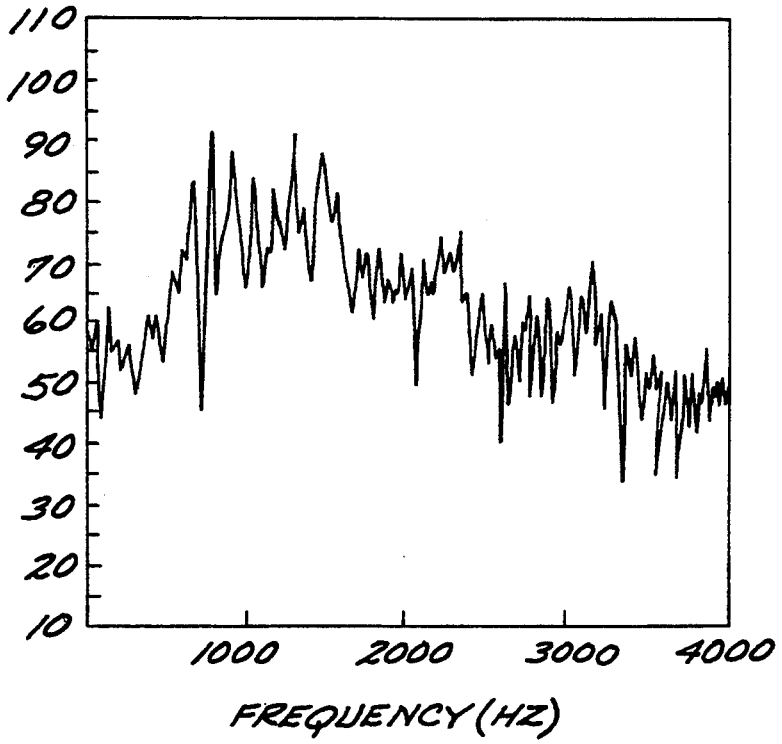

The input audio signal, with bandwidth W, is analyzed for two properties, cepstrum pitch and spectral rolloff. An exemplary input signal voice waveform is illustrated in FIGS. 2A and 2B in both the time domain and the frequency domain. In operation, the waveform characterizer 50 works as follows. The input signal (FIG. 2) is downconverted, and in-phase and quadrature components are digitized by analog-to-digital converters (ADC) 66 and 68 at a sample rate $R_s$ (higher than twice W to avoid aliasing). The samples are stored in memory (RAMS 70 and 72). The data is read out of RAMS 70 and 72 in blocks of N points (corresponding to a frame duration of $T=NR_s$) and after application of a Hamming window 74, the data is processed by cepstrum processor 75. First the data is transformed into the frequency domain using an N point FFT 76. The memory pointer is then shifted by N/2 and another N point block is processed. This N/2 overlapping allows more voicing decisions per second to be made while maintaining length N. This process is shown in FIG. 3.

Figure 4:
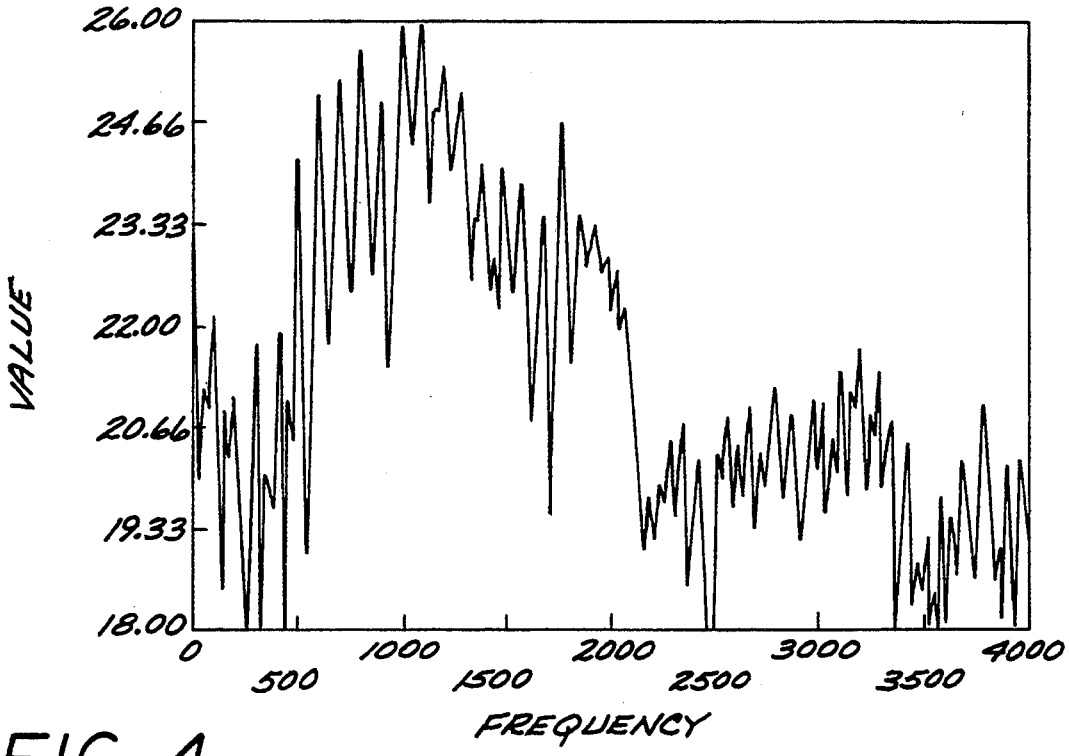
FIG. 4 illustrates the signal waveform of the logarithm of the squared spectral data, i.e., the output of element 78 of FIG. 1.
Figure 5A:
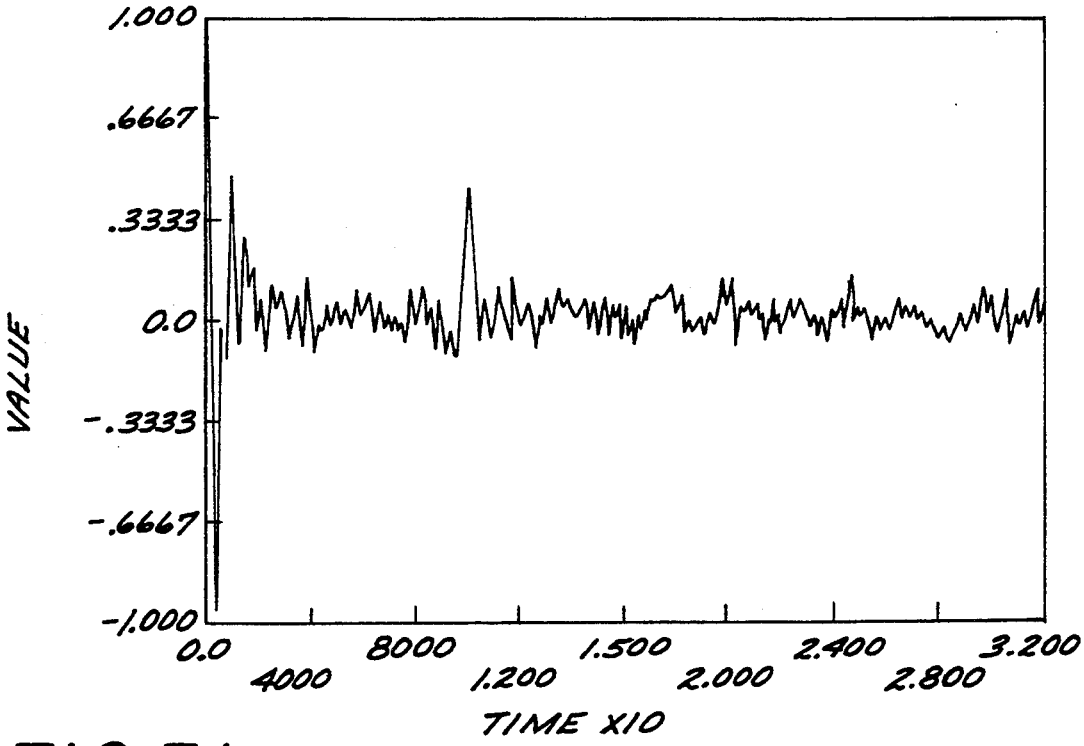
FIG. 5A illustrates the cepstrum of the input signal performed by the system of FIG. 1.

The output of the FFT 76 is a list of complex numbers. The magnitude of each number $a+ib$ is obtained by $(a^2+b^2)^{\frac{1}{2}}$ (taking the square root is not important since it is only a scaling) to obtain the magnitudes (amplitudes) of each number. Thus, after an N point FFT is performed on the input data by FFT 76, the magnitude spectrum is calculated and a logarithm function 78 is performed on the spectral data (FIG. 4). The log function 78 deconvolves the combination of the impulse train and the impulse response in the frequency domain. An N point inverse FFT 80 is then performed on the logarithm output data, the resulting output being the cepstrum of the original input signal (FIG. 5A).

Cepstral processing isolates the pitch period of the input signal as a single peak in the cepstrum located at the period of the signal. This peak is analogous to an autocorrelation function. A pitch detector 86 locates the pitch peak $A_T$ within a range $\tau$ to $t_1$ to $t_2$ and stores the peak magnitude value in memory. The values $t_1$ and $t_2$ are predetermined pitch periods which correspond to the minimum and maximum expected values for the signal in question. The maximum peak is located and the peak value $A_T$ recorded. The peak values of K consecutive frames are then combined and the sum compared against a threshold value $T_1$. The value of $T_1$ is determined by the pitch and rolloff threshold estimator 90.

Figure 5B:
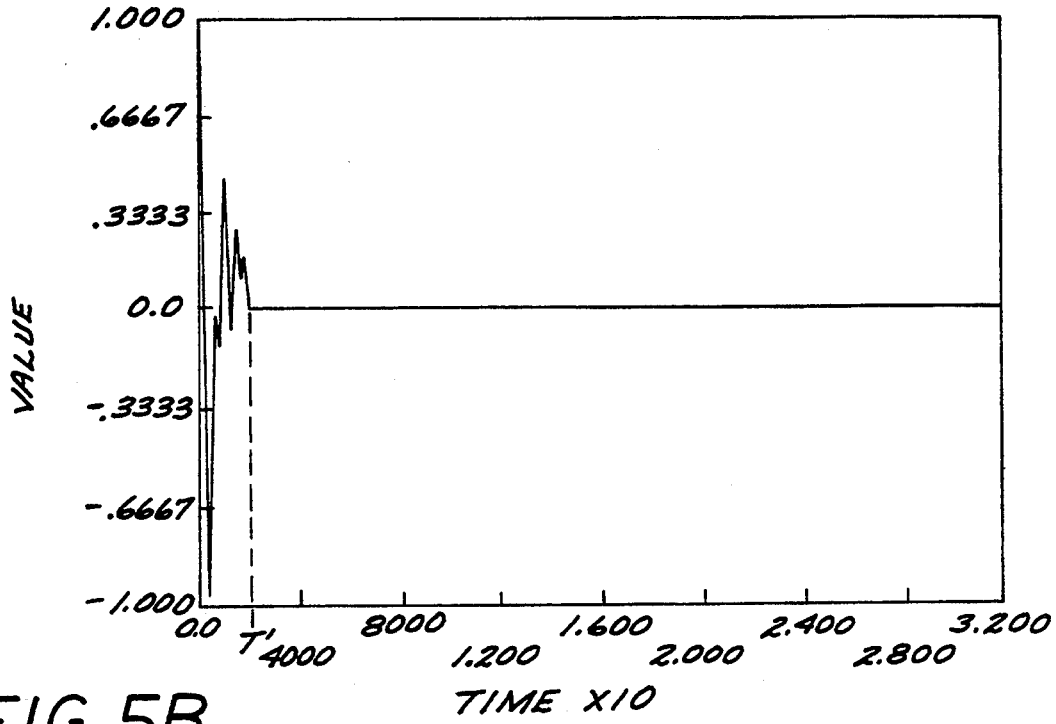
FIG. 5B shows the zeroing of all cepstral samples of the cepstrum of FIG. 5A except those between zero and T'.
Figure 6:
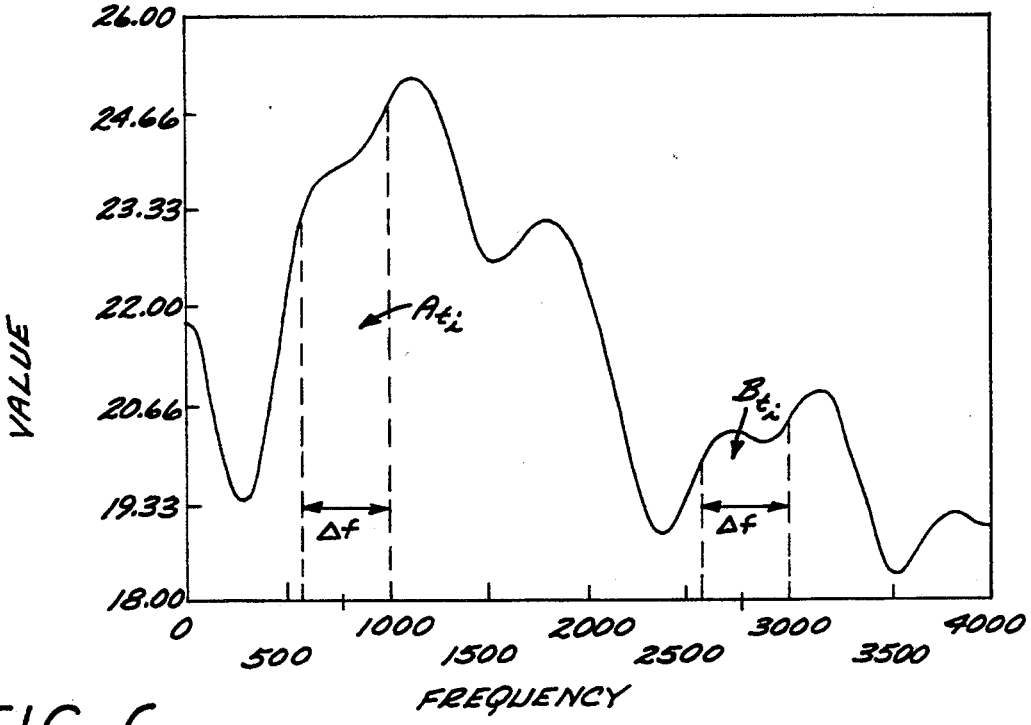
FIG. 6 illustrates the frequency domain transformation of the smoothed cepstrum signal.

The audio spectrum is smoothed in the following manner. All cepstral samples except those between 0 and T' are removed by writing zeroes in that area of the cepstrum (FIG. 5B). This operation, performed by the time window function 82, removes the repetitive impulse component of the signal. A forward FFT 84 is then performed on the cepstrum to transform it back into the frequency domain. The result is a smoothed spectrum of the original input signal (FIG. 6).

In the rolloff detector 88, spectral rolloff is measured by taking the energy in two frequency bins, $F_1 \pm \Delta f/2$ and $F_2 \pm \Delta f/2$, where $\Delta f$ is the frequency bin size, and comparing their relative magnitudes $A_{Ti}$ and $B_{Ti}$. This is done by summing a range of data points around both frequencies. The difference in energy in the two bins, $E(F_1 \pm \Delta f/2) - E(f_2 \pm \Delta f/2)$, is calculated. The values of K consecutive frames are combined and the result compared against a threshold value, $T_2$, determined by estimator 90. This is accomplished by the following relationship:

$$\sum_{i=1}^{K} A_{ti} - \sum_{i=1}^{K} B_{Ti} = \Delta \text{ Energy}$$

Voice detection is indicated by the combine logic 92 if $A_T$ is greater than or equal to $T_1$ or if $\Delta$ Energy is greater than or equal to $T_2$.

Example Design—Voice Squelch

A waveform characterizer in accordance with the invention can be employed, for example, in a receiver voice/squelch system. Human voice contains several unique properties which can be used to distinguish it from background noise and interfering signals. A typical voice waveform is shown in FIG. 5. The human voice waveform has the following characteristics:

1. Pitch Period—Voice is a periodic waveform with a constant pitch created by impulses from the vocal chords. The periodicity of the vocal chord impulses can be detected by transforming the signal into its corresponding cepstrum. The periodicity of the impulse train creates a cepstral peak with a location corresponding to the period. This peak can be detected by cepstrum processing.

Noise is generally an uncorrelated process. It is therefore not periodic and no cepstral peak is expected at the output of a cepstral processor. Thus, cepstrum processing can be used to reliably detect voice transmission with a low false alarm rate.

2. Spectral Rolloff—The frequency response of human voice consists of several formants, the resonant frequencies of the vocal cavity. These formants are typically low frequencies (500 Hz–1400 Hz), and the spectral energy of these formants is considerably higher than the spectral energy at higher frequencies. The presence of voice can be detected by measuring the spectral rolloff (formant detection) of the voice spectrum.

RF noise, on the other hand, is generally a white process in a narrow bandwidth. The noise spectrum roughly flat over the audio band. Thus, spectral rolloff measurement can reliably detect the presence of voice with a low probability of false alarm.

The following is a list of requirements which would be desirable in a squelch design. The channel quality is assumed to be such that the received signal has a signal-to-noise ratio of at least 10 dB to insure reliable communication. The audio bandwidth of the radio is assumed to be 300 Hz to 3000 Hz, a standard for SSB HF radios.

1. The probability of false alarm due to extraneous noise should be less than one every fifteen minutes.
2. The maximum processing delay should be 0.5 seconds. If this long of a delay is necessary, some method of data buffering should be used so that no information is lost in transmission.
3. The probability of detection within the specified processing delay should be greater than 99%.
4. After completion of speech, the channel should stay open for approximately one second to allow for normal pauses in speech.
5. The probability that squelch will close during speech should be less than $10^{-3}$.
6. The performance of the squelch should not be language dependent.
7. Operation of the squelch should be invisible to the operator. No manual adjustments should be necessary for optimum performance.
8. The squelch design should be single-ended. In other words, no special transmission schemes should be used. This will insure that any radio can be retrofitted with the squelch circuitry and will operate properly on any communication channel.

The following design parameters have been considered in analysis of the waveform characterizer.

Sampling Rate ($R_s$)

The analog-to-digital (A/D) sampling rate ($R_s$) must be greater than twice the audio bandwidth of the radio to avoid aliasing. A standard audio bandwidth of 3.0 KHz dictates that sampling occur at more than 6.0 KHz. 8.0 KHz can be used in order to allow reconstruction of the voice with minimal distortion from filtering. An A/D resolution of 12 bits allows sufficient dynamic range (72 dB) of the input signal.

Frame Length, FFT size (N)

In order for the cepstral peak to be constructed, the analysis frame must be of sufficient duration to contain enough impulses to define the period of the impulse train. Four impulses should be sufficient, and literature indicates a typical worst-case period of 15 milliseconds. A requirement of at least four impulses per frame leads to an analysis frame duration of at least 60 milliseconds.

In addition, to reduce complexity and increase speed in the FFT, the number of samples in the analysis frame should be a power of two. A frame length of 512 points results in a 64 msec frame. This number of points will give a frequency resolution of about 16 Hz.

Cepstrum Pitch range ($t_1$, $t_2$)

Literature suggests that the pitch period of human voice typically falls between 3 msec and 15 msec. These values can be chosen to be the bounds of the cepstral pitch search. In a 512 point frame, these values correspond to points 24 and 120.

Spectral Rolloff frequencies ($F_1$, $F_2$)

Though the frequency response of different speakers varies, the general shape of the human vocal response is fairly predictable. The location of the formants in voiced speech for males are approximately 500 Hz, 1400 Hz, and 2300 Hz, with the first formant having the highest amplitude. Formant locations for female speakers could be expected to be slightly higher, with the first formant located around 800 Hz.

The upper frequency must be chosen to be above the third formant (2300 Hz) and below the upper cutoff (e.g., 3000 Hz). A lower frequency ($F_1$) of 800 Hz and an upper frequency ($F_2$) of 2800 Hz can be chosen for one example. A frequency bin size ($\Delta f$) of 400 Hz can be used to measure the energy in each location.

Frame Combinations (K)

The number of frames combined before a threshold comparison is made will greatly affect the operation of the squelch. Increasing the number of frames increases the processed speech energy and thus increases the probability of detection. However, if the number of frames is too large, the dead space between syllables will be included in the measurement and probability of detection will drop. Simulation data shows that the shortest expected syllable length is four to five analysis frames (160 to 192 msec); therefore a value of five frames can be used in an exemplary design.

Exemplary Implementation of a Digital Voice Squelch System

Figure 7:
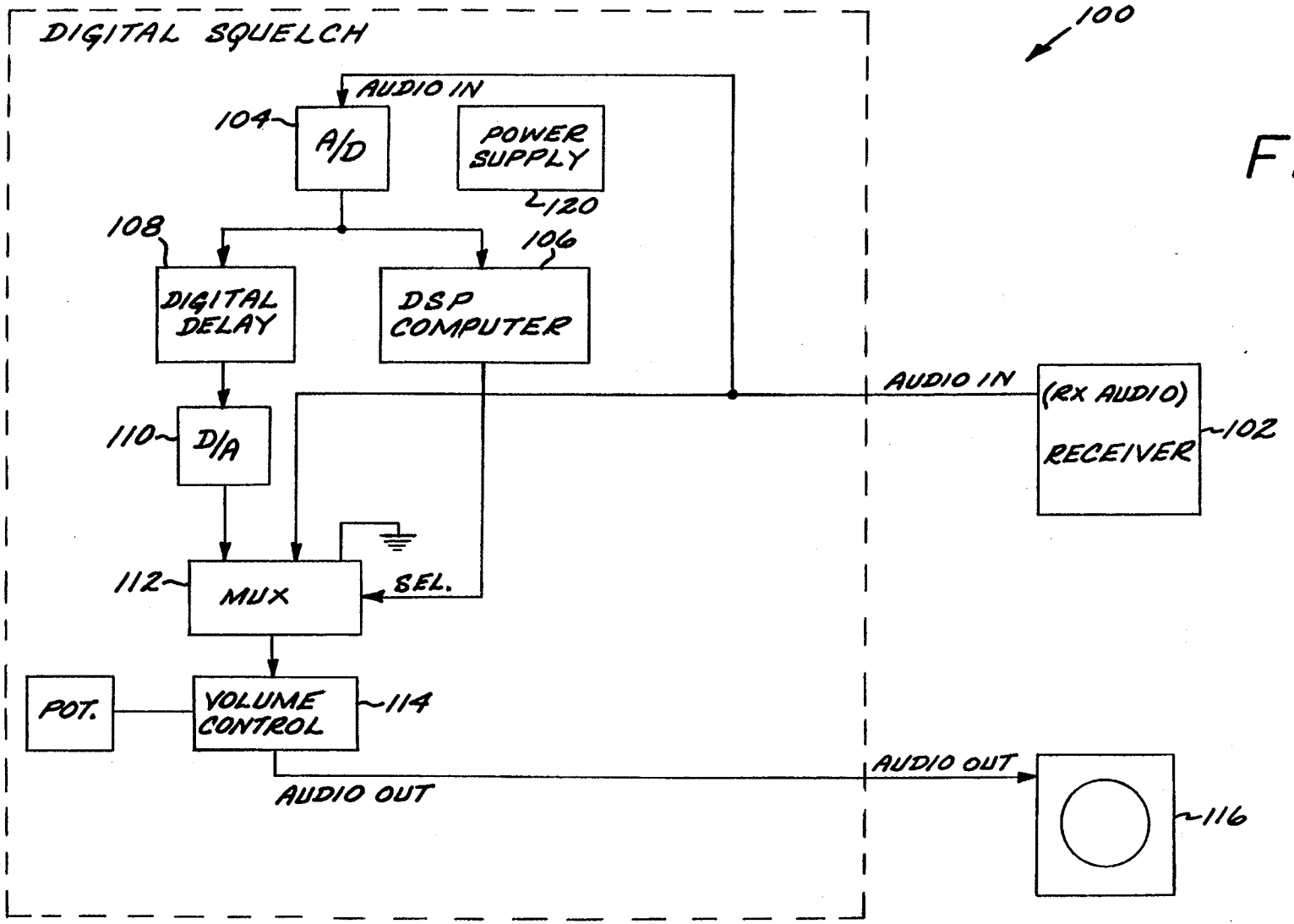
FIG. 7 is a simplified hardware block diagram of a digital voice squelch system embodying the invention.

Referring now to FIG. 7, a simplified hardware block diagram of a digital voice squelch system embodying the invention is shown. The system 100 processes the audio input signal from the receiver 102. The analog audio signal AUDIO IN is fed to an analog-to-digital converter (ADC) 104 which digitizes the signal. The digitized signal is then fed to a digital signal processor (DSP) 106 and to a digital delay circuit 108. The DSP 106 performs the processing described above to detect a voice signal on the audio input signal from the receiver 102. The delayed digitized signal from the digital delay circuit 108 is fed to a digital-to-analog converter (DAC) 110 to convert the delayed digitized signal back to analog form. The analog signal is then fed to a multiplexer circuit 112 as one selectable input signal. The other inputs to the multiplexer are the signal AUDIO IN and ground. The DSP 106 controls the particular input to the multiplexer 112 to be output to the volume control circuit 114 by a select signal SEL. Thus, the output of the multiplexer 112 can be selected to be the delayed version of the audio input signal, the undelayed signal AUDIO IN, or ground. If the audio signal does not contain voice information, the DSP 106 can squelch the audio output signal by selecting the ground input. The output of the volume control signal., AUDIO OUT, is fed to an audio transducer 116, comprising a speaker or headphone, for example.

Figure 8:
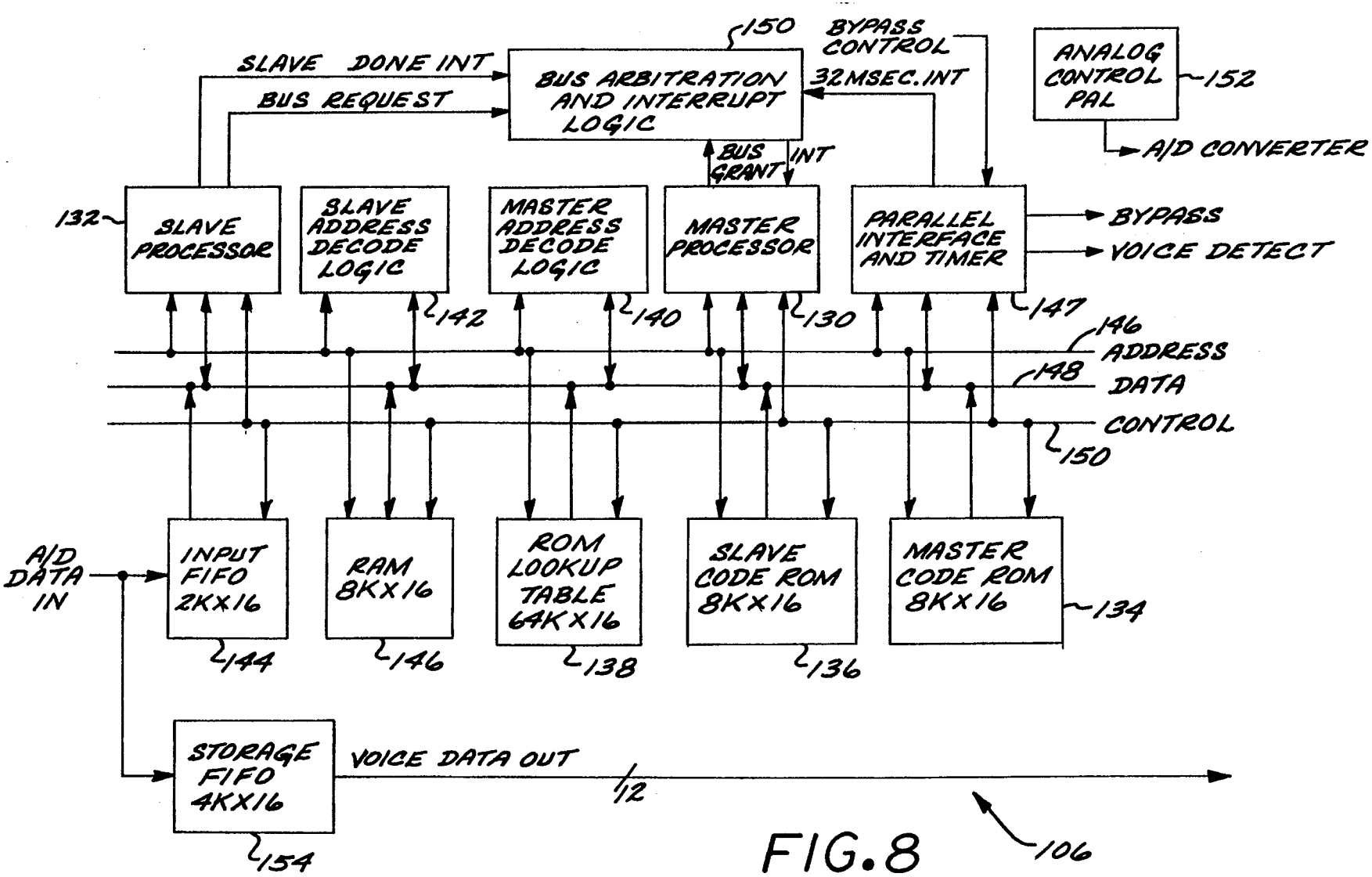
FIG. 8 is a schematic block diagram further illustrative of the digital signal processor employed in the system of FIG. 7.

FIG. 8 shows a block diagram of an exemplary implementation of the DSP 106. The DSP 106 shown here comprises a master processor 130 and a slave processor 132. A Motorola 68000 microcomputer is suitable for use as the master processor 130. A Zoran Vector Signal processor device, is suitable for use as the slave processor 132. The DSP 106 further comprises ROMS 134 and 136 which store codes for the master and slave controller devices, respectively. The ROM 138 is used as a lookup table to provide the logarithmic conversion function (block 60, FIG. 1).

Address decode logic circuits 140 and 142 are provided for the respective master and slave processors 130 and 132.

The digitized audio input data is provided to an input FIFO buffer 144. The DSP 106 employs address, data and control buses 146, 148 and 150 to exchange address, data and control signals among the respective components of the DSP 106. The input data is passed onto the data bus 150 in response to control signals.

The DSP 106 further comprises a random access memory 146, a parallel interface and timer device 148, which may comprise a type 68230 device, and a bus arbitration and interrupt logic circuit 150. The logic circuit 150 receives timing data from the interface and timer circuit 148, and controls the interrupt routines of the master and slave processors 130 and 132.

The system 100 further comprises a power supply 120 providing +5 V, +12 V, and −12 V.

Figure 9:
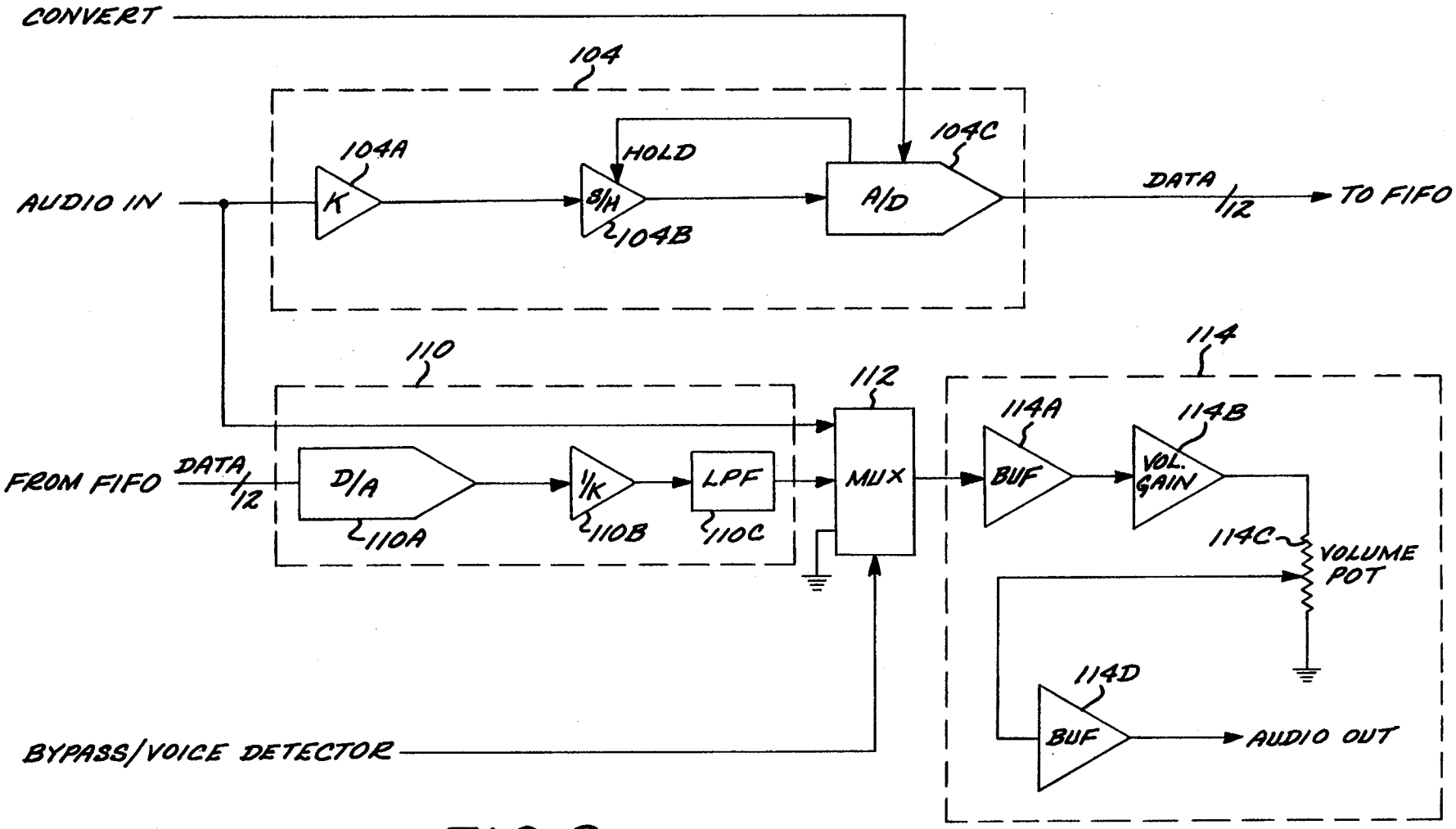
FIG. 9 is a block diagram of the analog signal circuit of the system of FIG. 7.

The analog signal section of the system 100 is shown in further detail in FIG. 9. The ADC 104 comprises a scaling amplifier 104A, a sample and hold intergrated circuit device 104B, and a 12 bit ADC device 104C. The maximum input signal is 2.0 V peak. The scaling amplifier 104A scales the input signal to the undistorted maximum allowed input of the ADC device 104C. The ADC device 104C is issued a convert pulse every 125 microseconds (8 KHz) by the analog control circuit 150. The DAC 110 consists of a D/A converter device 110A, a scaling amplifier 110B, and a forth order Butterworth filter 110C. The output of the DAC 110 is fed to the multiplexer 112, whose output drives the output volume control circuit 114. The circuit 114 comprises another scaling amplifier 114B, and two output buffers 114A and 114D. The first output scaler 110B scales the output of the DAC device 110A back down to the level of the input signal AUDIO IN. The maximally flat filter 110C has a cutoff frequency of 3.5 KHz to filter out the sampling images (centered at multiples of 8 KHz). The analog multiplexer is controlled by the DSP 106, allowing the output audio to be transmitted only when voice is detected or allowing audio to be transmitted continually during bypass modes of operation. The output of the multiplexer 112 is buffered (114A), scaled (114D), and then output to an audio tapered potentiometer 114C. The output of the potentiometer 114C is then buffered and output to the transducer 116.

The DSP 106 receives 12 bits of sampled data from the ADC 104 at a 8 KHz clock rate. The data is sent to the 2 K input FIFO 144 and to a 4 K data storage FIFO buffer 154 which performs the function of the digital delay device 108 (FIG. 7).

As described above, the DSP 106 has two processors 130 and 132 on the data bus. Each processor 130 and 132 has its own code ROM (8K×16), devices 134 and 136, and together they share a common data RAM 146 (8K×16). The slave processor 132 alone can read data from the input FIFO 144. The processor 130 acts as the bus master and can pass bus control to the slave processor 132 by writing a start command to the processor 132. The slave processor 132 then takes control of the data bus 148 and when finished, issues an interrupt to the master processor 130, indicating that the master processor 130 can resume processing.

The parallel interface and timer 147 (PIT) provides an interrupt to the master processor 130 every 32 milliseconds to signal that it is time to start processing a new block of data. The PI/T 147 also generates the control to the audio output multiplexer 112, allowing voice to be transmitted or squelched, depending on the output of the cepstrum algorithm or the mode of operation (active or bypass). The PI/T 147 also controls when data is allowed to fill up in the input FIFO 144, storing the amount of audio data that is received during the cepstrum processing time.

All decoding, timing, and glue logic is performed by a total of five programmable array logic devices. One device 140 is used for master processor 130 address decoding, another device 142 for slave processor 132 address decoding. Another device 140 includes a state machine used by the master processor 130 to read and write to the control registers of the slave processor 132. Another device 150 is used for interrupt and bus arbitration logic; and another device 152 is used to generate the analog control and input FIFO control signals. The decoding requires all memory accesses to be word length, and requires that the 68000 microcomputer used as the master processor 130 be operated in the supervisor mode.

Three clocks are used for the DSP 106, 20 MHz for the slave processor 132, 10 MHz for the master processor 130, and 256 KHz for various timing functions.

Figure 10:
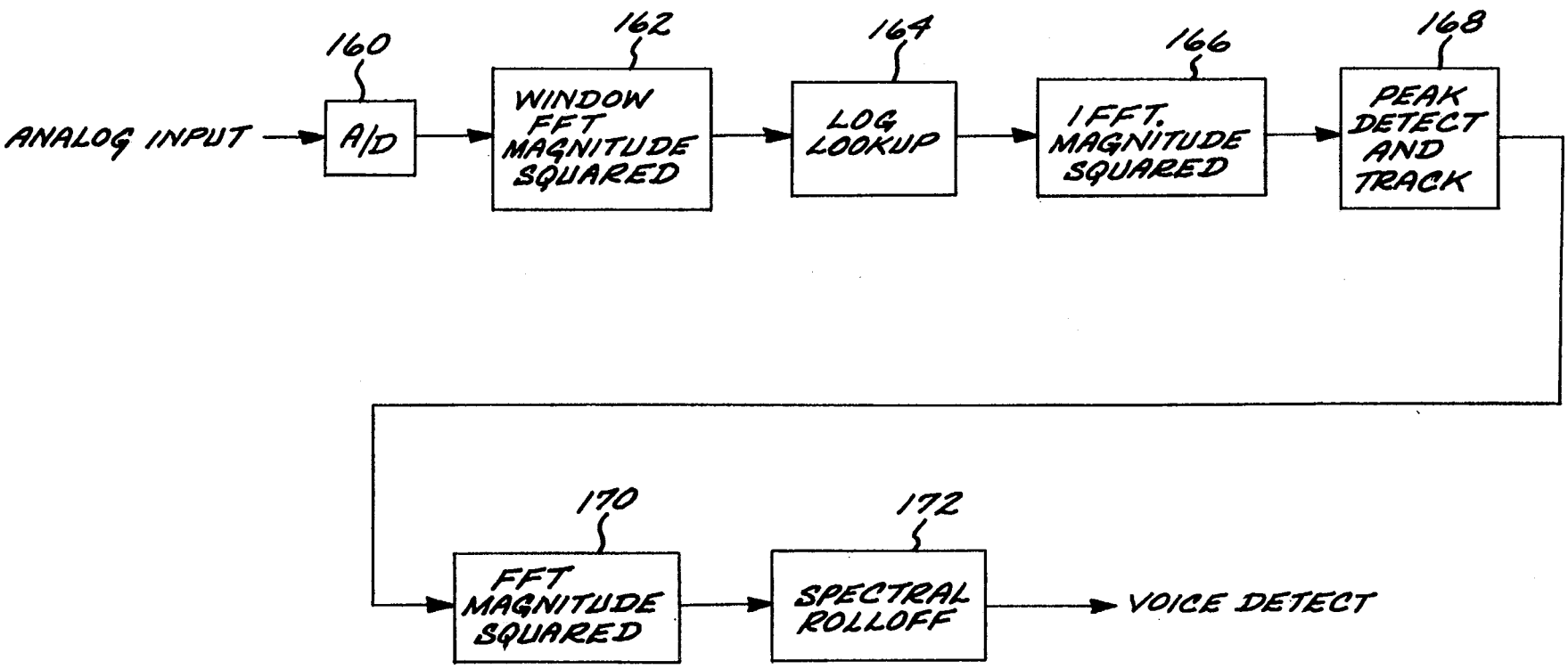
FIG. 10 is a simplified flow diagram illustrative of the operation of the system of FIG. 7.

FIG. 10 shows a simplified functional flow diagram of the processing of the analog audio data by the system of FIG. 5. At step 160 the analog data is digitized (ADC 104), and the digitized data is processed (step 162) to window, fast Fourier transform and perform the magnitude squared functions. The processing functions of step 162 are performed by the slave processor 132 in this embodiment.

At step 164 the logarithmic conversion function is performed, under control of the master processor 130, by use of the log lookup table stored in ROM 138. Step 166 represents the inverse FFT function and magnitude squared function performed by the slave processor 132. At step 168 peak detection and tracking functions are performed by the master processor 130. At step 170 another FFT function and magnitude square function is performed by the slave processor 132. The spectral rolloff of tile resultant signal is then processed by the master processor 130, and the voice detection decisions are made.

The following is a summary of important characteristics of the waveform characterizer and an application thereof for digital squelch.

Waveform Characterization

1. Waveform characterizer circuit processing performed in the transform domain with FFT and logarithmic processing is simple to implement.

2. The waveform characterization technique is applicable to a broad range of signal modulations including SSB voice, PSK, and, teletype. Cepstrum processing is sensitive to interference signals such as FSK, PSK and CW transmission. This fact indicates that the cepstrum can be used to detect and possibly characterize radio frequency transmission. The properties associated with voice that allow for cepstral detection are the presence of a cepstral peak and a unique spectral profile. The voice cepstral peak can be slowly moving from 3 msec to 15 msec, while the voice spectral content at 2500 Hz is much smaller than that at 800 Hz. Digital signals, such as FSK and PSK, also exhibit similar characteristics. The periodic cepstral peaks indicate the fixed baud rate of the transmission, and the spectral distribution identifies the modulation waveform used. Thus, the unique spectrum and cepstrum characteristics of the PSK and FSK makes the cepstral processor an excellent candidate for use as a waveform characterizer. Characterization ability would allow for automatic detection and routing of a signal to the proper receiver, such as a modem teletype or speaker, for demodulation, thus freeing the operator to concentrate on other tasks. Another benefit is the ability to track and identify multiple signals simultaneously and automatically. The received waveform can be characterized in the following manner. The cepstral peak of a voice signal will be located within a known window in the cepstrum, but its location will change over time. The peak of an FSK or PSK signal will be fixed, and its location will correspond to the symbol rate. The spectral profile of voice will vary smoothly over frequency. The profiles of data signals, on the other hand, will exhibit sharp peaks. While PSK displays a single peak with sin(x)/x spectral density, FSK displays two or more main lobes corresponding to the number of frequencies used in the bandwidth. Thus, the signal characteristics can be used to completely determine the characteristics of the received signal and to route the signal to the appropriate receiver for demodulation.

Digital Squelch

3. The squelch circuitry performs the cepstral pitch and spectral rolloff detection sequentially to fully utilize the FFT processor, but makes the voicing decision by combining the two detection schemes in parallel. The parallel combination of the schemes improves the squelch performance.

4. The digital squelch apparatus performs reliably in a noisy channel condition.

5. By digitizing the input signal, storing it, and reconstructing it upon detection of voice, the entire voice message is relayed to the operator. Conventional squelch designs lose a portion of the signal during processing.

6. The squelch apparatus is speaker and language independent.

7. The design can be implemented into existing high frequency radios without modifying the design (i.e., it has backward compatibility).

It is understood that the above-described embodiments are merely illustrative of the possible specific embodiments which may represent principles of the present invention. Other arrangements may readily be devised in accordance with these principles by those skilled in the art without departing from the scope of the invention. For example, another application for the invention (other than in a squelch circuit) is as a waveform characteristic extractor. The extractor can be used to provide information on the spectral and temporal properties of a received waveform, which could then, for example, be used to determine the proper type of demodulation to use on the signal.

What is claimed is:

1. A waveform characterizer apparatus for determining cepstrum pitch and spectral rolloff properties of an input signal waveform, comprising:

means for digitizing the input signal waveform to provide a digital waveform signal;

means for providing the cepstrum of the input signal waveform including means for transforming the digitized input signal waveform into the frequency domain which includes memory means for storing said digital samples in memory, means for reading said digital samples out of said memory means in blocks of N samples corresponding to a frame duration of T=NR, and means for transforming said respective blocks of digital data samples into the frequency domain by a fast Fourier transform algorithm;

means for deconvolving the impulse response and periodicity of the frequency domain signal to provide a deconvolved digital signal; and means for transform the deconvolved digital signal back into the time domain to provide the cepstrum of the input signal waveform; and means for isolating the pitch period of the input signal waveform as a single peak in the cepstrum located at the period of the signal and determining the peak pitch magnitude value; and means for determining the spectral rolloff of the input signal waveform from the cepstrum of the input signal waveform.

2. The apparatus of claim 1 wherein said means for digitizing said input waveform signal comprises:

analog-to-digital converter means for digitizing said waveform at a sampling rate, R, which is higher than twice the bandwidth W of the input waveform signal.

3. The apparatus of claim 2 further comprising means for detecting the presence of voice components in said input signal waveform, comprising:

means for comparing said peak pitch magnitude value to a predetermined pitch threshold value;

means for comparing said energy difference to a predetermined energy threshold value; and means for generating a signal indicative of the voice component present condition if said peak pitch magnitude value exceeds said pitch threshold value or if said energy difference exceeds said energy threshold value.

4. The apparatus of claim 3 wherein the cepstrum is provided for respective frames of digitized input data, and further comprising means for combining the respective peak magnitude values of K consecutive frames to provide a resultant combined value which is compared against said pitch threshold value, and wherein said pitch threshold value is determined in dependence on K frames.

5. The method of claim 4 further comprising means for combining the respective energy difference values for said K consecutive frames to provide a resultant combined energy difference value which is compared against said energy threshold value, and wherein said energy threshold value is determined in dependence on K frames.

6. The apparatus of claim 1 wherein said means for reading said data from memory employs a data address pointer to address the memory and further comprises means for shifting said pointer by N/2 points to achieve N/2 overlapping of the data samples read out from memory and transformed to the frequency domain.

7. A voice detection apparatus for the audio output signal of a receiver, comprising:

means for providing digital samples of the analog audio signal;

a digital delay line for providing a time delayed version of said digital samples;

means for converting the delayed version of said digital samples to an analog signal;

multiplexer means responsive to a select signal for selecting one of three inputs, said inputs comprising said analog signal, said audio output signal of the receiver, and a ground potential;

audio transducer means responsive to the selected one of the multiplexer signals to provide the voice/squelch output signal; and a digital processor means responsive to said digital samples of the audio output signal of the receiver to generate said select signal, said processor comprising:

means for transforming the digital audio signal samples into the frequency domain;

means for deconvolving the combination of the impulse train and the impulse response of the digital samples in the frequency domain;

means for transforming the deconvolved data back to the time domain to provide the cepstrum of the audio signal;

means for processing the cepstrum to isolate the pitch period of the audio signal as a single peak in the cepstrum located at the period of the signal and recording the pitch peak magnitude;

means for removing the cepstral samples comprising the cepstrum except those located between zero and a value T' and transforming the resultant modified cepstrum into the frequency domain to provide a smoothed spectrum of the input audio signal;

means for measuring the spectral rolloff in the smoothed spectrum by determining the spectral energy in two frequency bins and calculating the energy difference between the two bins;

means for comparing the peak magnitude value to a first predetermined threshold value and said energy difference to a second predetermined threshold to detect the presence of a voice component if either said peak magnitude value or said energy difference equals or exceeds said respective threshold value; and means for generating said select signal to select said ground input to said multiplexer if a voice component is not detected in said audio signal.

8. The apparatus of claim 7 wherein said audio output signal of a receiver is characterized by a bandwidth W, and wherein said means for providing digital samples comprises analog-to-digital converter means for digitizing said audio output signal at a sampling rate, R, which is higher than twice said bandwidth W.

9. The apparatus of claim 8 wherein digital processor further comprises a digital memory for storing said digital audio signal samples, and said means for transforming the digital audio signal samples into the frequency domain comprises:

means for reading said digital samples out of said memory means in block of N samples corresponding to a frame duration of T=NR; and means for transforming said respective blocks of digital data samples into the frequency domain by a fast Fourier transform algorithm.

10. The apparatus of claim 9 wherein said means for transforming the digitized input signal waveform into the frequency domain comprises:

memory means for storing said digital samples in memory;

means for reading said digital samples out of said memory means in blocks of N samples corresponding to a frame duration of T=NR; and means for transforming said respective blocks of digital data samples into the frequency domain by a fast Fourier transform algorithm.

11. The apparatus of claim 7 wherein said means for deconvolving comprises means for squaring the magnitudes of the transformed spectral data and performing a logarithm function on the squared data.

12. A method for determining cepstrum pitch and spectral rolloff properties of an input signal waveform, comprising a sequence of the following steps:

digitizing the input signal waveform to provide a digital waveform signal;

providing the cepstrum of the input signal waveform including transforming the digitized input signal waveform into the frequency domain, which includes storing digital samples in memory, reading said digital samples out of said memory means in blocks of N samples corresponding to a frame of duration of T=NR, and transforming said respective blocks of digital samples into the frequency domain by a fast Fourier transfrom algorithm;

deconvolving the impulse response and periodicity of the frequency domain signal to provide a deconvolved digital signal, and transforming the deconvolved digital signal back into the time domain to provide the cepstrum of the input signal waveform;

isolating the pitch period of the input signal waveform as a single peak in the cepstrum located at the period of the signal and determining the peak pitch magnitude value; and determining the spectral rolloff of the input signal waveform from the cepstrum of the input signal waveform.

13. The method of claim 12 wherein said step of digitizing said input waveform signal comprises digitizing said waveform at a sampling rate, R, which is higher than twice the bandwidth W of the input waveform signal.

14. The method of claim 12 wherein said step of reading said data from memory includes using a data address pointer to address the memory and shifting said pointer by N/2 points to achieve N/2 overlapping of the data samples read out from memory and transformed to the frequency domain.

15. The method of claim 12 wherein said step of deconvolving comprises squaring the magnitudes of the transformed spectral data and performing a logarithm function on the squared data.

16. The method of claim 12 wherein said step of determining the spectral rolloff of the input signal waveform comprises:

removing the cepstral samples comprising the cepstrum except those located between zero and a value T', and transforming the resultant modified cepstrum into the frequency domain to provide a smoothed spectrum of the input signal waveform; and measuring the spectral rolloff in the smoothed spectrum by determining the spectral energy in two frequency bins and calculating the energy difference between the two bins.

17. The method of claim 12 further comprising the step of detecting the presence of voice components in said input signal waveform, comprising:

comparing said peak pitch magnitude value to a predetermined pitch threshold value;

comparing said energy difference to a predetermined energy threshold value; and generating a signal indicative of the voice component present condition if said peak pitch magnitude value exceeds said pitch threshold value or if said energy difference exceeds said energy threshold value.

18. The method of claim 17 wherein the cepstrum is provided for respective frames of digitized input data, and further comprising the step of combining the respective peak magnitude values of K consecutive frames, and wherein said pitch threshold value is determined in dependence on K frames.

19. The method of claim 18 further comprising the step of combining the respective energy difference values for said K consecutive frames, and wherein said energy threshold value is determined in dependence on K frames.

20. A method for detecting a voice signal component in an audio signal, comprising a sequence of the following steps:

converting the audio signal into digital audio signal samples;

transforming the digital audio signal samples into the frequency domain;

deconvolving the combination of the impulse train and the impulse response of the digital samples in the frequency domain;

transforming the deconvolved data back to the time domain to provide the cepstrum of the audio input signal;

processing the cepstrum to isolate the pitch period of the input signal as a single peak in the cepstrum located at the period of the signal and recording the peak magnitude value signal;

removing the cepstral samples comprising the cepstrum except those located between zero and a value T' and transforming the resultant cepstrum into the frequency domain to provide a smooth spectrum of the input audio signal;

measuring the spectral rolloff in the smoothed spectrum by determining the spectral energy in two frequency bins and calculating the energy difference between the two bins;

comparing said peak magnitude value to a first predetermined threshold value and said energy difference to a second predetermined threshold to detect said voice component if either said peak magnitude value or said energy difference equals or exceeds said respective threshold value.

21. The method of claim 20 wherein said deconvolving step comprises calculating the square of said respective frequency domain signal samples and performing a logarithm function on the squared spectral data.

22. The method of claim 20 wherein said audio signal is characterized by a bandwidth W, and said step of converting the audio signal into digital audio signal samples comprises digitizing said signal at a sampling rate, R, which is higher than twice the bandwidth W.

23. The method of claim 20 wherein said step of transforming the digitized input signal waveform into the frequency domain comprises:

storing said digital samples in memory;

reading said digital samples out of said memory means in blocks of N samples corresponding to a frame duration of T=NR; and transforming said respective blocks of digital data samples into the frequency domain by a fast Fourier transform algorithm.

24. The method of claim 23 wherein said step of reading said data from memory includes using a data address pointer to address the memory and shifting said pointer by N/2 points to achieve N/2 overlapping of the data samples read out from memory and transformed to the frequency domain.

25. The method of claim 20 wherein said step of determining the spectral rolloff of the input signal waveform comprises:

removing the cepstral samples comprising the cepstrum except those located between zero and a value T', and transforming the resultant modified cepstrum into the frequency domain to provide a smoothed spectrum of the input signal waveform; and measuring the spectral rolloff in the smoothed spectrum by determining the spectral energy in two frequency bins and calculating the energy difference between the two bins.

26. A waveform characterizer apparatus for determining cepstrum pitch and spectral rolloff properties of an input signal waveform, comprising:

means for digitizing the input signal waveform to provide a digital waveform signal;

means for providing the cepstrum of the input signal waveform including means for transforming the digitized input signal waveform into the frequency domain, means for deconvolving the impulse response and periodicity of the frequency domain signal to provide a deconvolved digital signal including means for squaring the magnitudes of the transformed spectral data and performing a logarithm function on the squared data, and means for transforming the deconvolved digital signal back into the time domain to provide the cepstrum of the input signal waveform;

means for isolating the pitch period of the input signal waveform as a single peak in the cepstrum located at the period of the signal and determining the peak pitch magnitude value; and means for determining the spectral rolloff of the input signal waveform from the cepstrum of the input signal waveform.

27. A waveform characterizer apparatus for determining cepstrum pitch and spectral rolloff properties of an input signal waveform, comprising:

means for digitizing the input signal waveform to provide a digital waveform signal;

means for providing the cepstrum of the input signal waveform;

means for isolating the pitch period of the input signal waveform as a single peak in the cepstrum located at the period of the signal and determining the peak pitch magnitude value; and means for determining the spectral rolloff of the input signal waveform from the cepstrum of the input waveform including means for removing the cepstral samples comprising the cepstrum except those located between zero and a value T', and transforming the resultant modified cepstrum into the frequency domain to provide a smoothed spectrum of the input signal waveform, and means for measuring the spectral rolloff in the smoothed spectrum by determining the spectral energy in two frequency bins and calculating the energy difference between the two bins.

* * * * *